US005765608A

United States Patent [19]

Kristen

[11] Patent Number: 5,765,608

[45] Date of Patent: Jun. 16, 1998

[54] HAND HELD VACUUM DEVICE

[75] Inventor: Hanns J. Kristen, San Anselmo, Calif.

[73] Assignee: Tilia International, Kowloon, Hong Kong

[21] Appl. No.: 555,363

[22] Filed: Nov. 8, 1995

[51] Int. Cl.[6] ..... B65B 1/04

[52] U.S. Cl. ..... 141/198; 141/65; 141/96

[58] Field of Search ..... 141/65, 96, 95, 141/192, 198; 200/83 N, 83 A, 83 B, 83 R, 83 P; 99/472; 417/44.2, 44.9; 128/204.23, 204.26, 204.27

[56] References Cited

U.S. PATENT DOCUMENTS

| | | | |
|---|---|---|---|
| 2,790,869 | 4/1957 | Hansen | 200/83 P |
| 2,921,159 | 1/1960 | Elderton et al. | 200/83 P |
| 3,296,395 | 1/1967 | Fraser | 200/83 A |
| 3,592,244 | 7/1971 | Chamberlin | 141/3 |
| 3,688,064 | 8/1972 | Myers | 200/83 N |
| 3,689,719 | 9/1972 | Phillips et al. | 200/83 P |
| 5,195,427 | 3/1993 | Germano | 141/65 |

FOREIGN PATENT DOCUMENTS

| | | |
|---|---|---|
| 197709 | 9/1977 | U.S.S.R. . |

*Primary Examiner*—David J. Walczak
*Assistant Examiner*—Steven O. Douglas
*Attorney, Agent, or Firm*—Fliesler, Dubb, Meyer & Lovejoy LLP

[57] ABSTRACT

A hand held device for forming a vacuum within a container. The device includes a pump for drawing a vacuum within the container and a motor for driving the pump. A vacuum sensor is connected to control circuitry for indicating when a vacuum has been established within the container.

16 Claims, 6 Drawing Sheets

HAND HELD VACUUM DEVICE

BACKGROUND OF THE INVENTION

1. Field of the Invention

The present invention relates to a device for forming a vacuum within a container, and in particular to a hand held device for evacuating fluid from a container including a vacuum sensor for sensing the amount of fluid pumped out of the container.

2. Description of the Related Art

Various apparatus and methods are known for the purpose of vacuum sealing containers to protect perishables, such as foodstuffs and other products stored within the container, against oxidation. One type of vacuum sealing system, primarily used for commercial packaging purposes, includes a vacuum chamber in which the entire packaged product is placed, along with heat sealers for sealing the package once a vacuum has been substantially established within the interior of the package.

Another type of conventional vacuum sealing system is manufactured to be more compact and economical for home use. One such system is disclosed in applicant's U.S. Pat. No. 4,941,310 entitled "APPARATUS FOR VACUUM SEALING PLASTIC BAGS", which in one embodiment discloses a vacuum chamber including an opening defined by a stationary support member and a moveable hood. An open end of a container such as a bag to be sealed is received within the vacuum chamber between the support member and the moveable hood, such that when the hood is moved to a closed position, a sealed environment including the vacuum chamber and the interior of the bag is established. A preferred type of bag for use with such a system is disclosed in applicant's U.S. Pat. No. 4,756,422, entitled, "PLASTIC BAG FOR VACUUM SEALING", which bag is provided with a series of air channels on interior surfaces of the bag. The air channels allow fluid flow from the bag into the vacuum chamber, thereby allowing evacuation of the bag even though the open end of the bag is firmly held between the support member and moveable hood.

After the moveable hood is located in the closed position with the open end of the bag located within the vacuum chamber, a pump within the device evacuates the fluid from within the bag. Once a vacuum is substantially established within the bag, a heat source seals the opening of the bag thereby vacuum sealing the perishable goods within the bag. U.S. Pat. No. 4,941,310 alternatively discloses a vacuum device including a plastic vacuum tube having a first end sealably connected to the vacuum chamber and a second end sealably connected to a container having a lid customized to receive the second end of the vacuum tube. According to this embodiment, the vacuum packaging system may establish a vacuum in a container.

Conventional vacuum packaging systems for home use tend to be large, expensive, and stationary such that containers to be sealed must be brought to the vacuum packaging device. As an alternative, hand held vacuum packaging devices have been developed for creating a vacuum within a bag and/or container. For example, U.S. Pat. No. 5,287,680 entitled "Vacuum Packing Device" and U.S. Pat. No. 5,215,445 entitled "Handy Vacuum Pump and Heat Sealer Combination Device" disclose hand held devices for evacuating fluid from the bag and for thereafter sealing the bag. Similarly, U.S. Pat. No. 5,195,427 entitled "Suction Device to Create a Vacuum in Containers" discloses a hand held device including a suction pump having a tip received within a container cover customized to receive the tip, to thereby allow evacuation of fluid from the container.

U.S. Pat. No. 5,195,427 includes a pump for evacuating the container, and a motor for driving the pump via a gear assembly used to transmit the motor torque to the pump. An electronic vacuum sensor is also provided for sensing the formation of a vacuum within a container based on the increase in the current being drawn by the pump motor as a result of vacuum formation. A shortcoming to such a vacuum forming device, as well as devices employing current-measuring vacuum sensors in general, is that current draw is directly dependent on motor characteristics, which may vary from motor to motor. As such, the point at which such vacuum forming devices indicate the formation of a vacuum will vary from device to device.

SUMMARY OF THE INVENTION

It is therefore an object of the present invention to provide an improved hand held vacuum packaging device including a more simple, inexpensive, and efficient system for transmitting motor torque to the reciprocating pump piston.

It is a further object of the present invention to provide a hand held vacuum packaging device including an improved sensor for indicating a vacuum within the container to be evacuated.

These and other objects are accomplished by the present invention, which relates in general to a hand held vacuum device for evacuating fluids from a container. The device includes a generally cylindrical housing tapering to a tip which may be inserted into a container through a specially designed container lid. The device further includes a conventional multi-pole motor electrically coupled to a power source. A shaft extends from the motor along an axis of rotation of the motor, on which shaft a cylindrical disc member is mounted for about the axis of rotation. The disc member includes an eccentric shaft extending from, and eccentrically mounted with respect to, the disc member, such that the eccentric shaft traces a circular path upon rotation of the disc member.

A connecting rod is pivotally mounted to the eccentric shaft so that the rod reciprocates in a plane perpendicular to the axis of rotation of the motor and disc member as the disc member and eccentric shaft rotate. The connecting rod is in turn mounted to a pump comprised of a piston mounted for reciprocation within a chamber.

The chamber is provided with an intake valve, connected to an opening in the device tip via an air-tight tube extending between the chamber and the tip, and an exhaust valve through which fluid is expelled from the chamber. The intake and exhaust valves include one-way flaps which are provided such that the intake valve flap is open and the exhaust valve flap is sealed when the piston reciprocates through a first phase where fluid is drawn from the container; and the intake valve flap is sealed and the exhaust valve flap is open when the piston reciprocates through a second phase where fluid is expelled from the chamber.

The hand held device according to the present invention further includes a sensor within the housing for indicating when a substantial vacuum has been formed within the container. Upon formation of a substantial vacuum within a container, the sensor generates a signal which is used to visually indicate the formation of a vacuum within a container and/or to shut down further pump operation.

In one embodiment of the invention, the sensor may comprise a piezoelectric member mounted adjacent to the exhaust valve. The member measures the intensity of the fluid pulses expelled from the exhaust valve, which intensity will decrease as a vacuum is formed in the container. The sensor generates a signal based on the measured intensity, which signal may be used to dynamically indicate vacuum formation within the container and/or to shut down operation of the pump when the signal reaches a threshold level.

In a second embodiment of the invention, the vacuum sensor may comprise a two way switch mounted adjacent to, and in fluid communication with, the air-tight tube extending between the device tip and the pump intake valve. The switch includes a flexible contact membrane normally biased into a first position. When the pressure within the container and the air-tight tube drops below a certain threshold level, the pressure differential on opposite sides of the membrane forces the membrane into a second position, at which point a signal is generated to indicate the formation of a vacuum within the container.

Control circuitry is provided within the housing to receive the sensor output from the sensor of either embodiment, and to control the overall operation of the device. A push button may be provided on the exterior of the housing to activate the device motor via the control circuitry.

BRIEF DESCRIPTION OF THE DRAWINGS

The invention will now be described with reference to the accompanying drawings in which.

DETAILED DESCRIPTION

The present invention will now be described with reference to FIGS. 1–8 which in general relate to a hand held device for forming a vacuum within a container. It is understood, however, that the present invention may be adapted for use with other vessels to be sealed, such as, for example, a plastic bag disclosed in the above-described U.S. Pat. No. 4,756,422.

Figure 1:
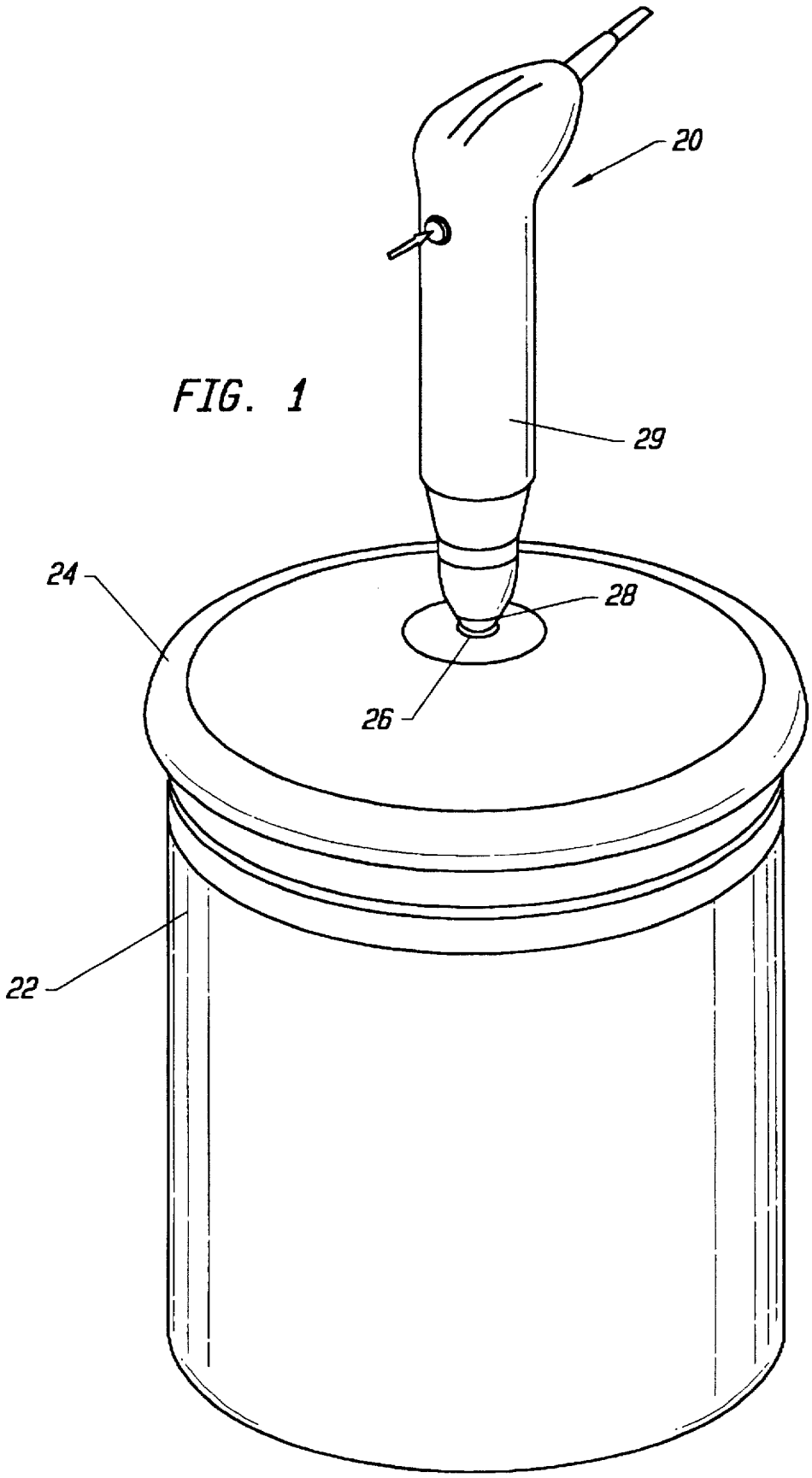
FIG. 1 is a perspective view of a hand held device according to the present invention engaged with a container for use with the present invention.

Referring now to FIG. 1, there is shown a hand held device vacuum 20 engaged with a container 22 for the purpose of evacuating fluid from the container 22. Container 22 includes a cover 24 having a valve 26 specially adapted for use with the present invention. A tip 28 of the device 20 may be inserted in the valve 26 so as to communicate with the interior of the container 22. Upon removal of the device 20 from the valve 26, the valve 26 prevents passage of fluids between the interior of container 22 and the environment surrounding container 22.

Figure 2A:
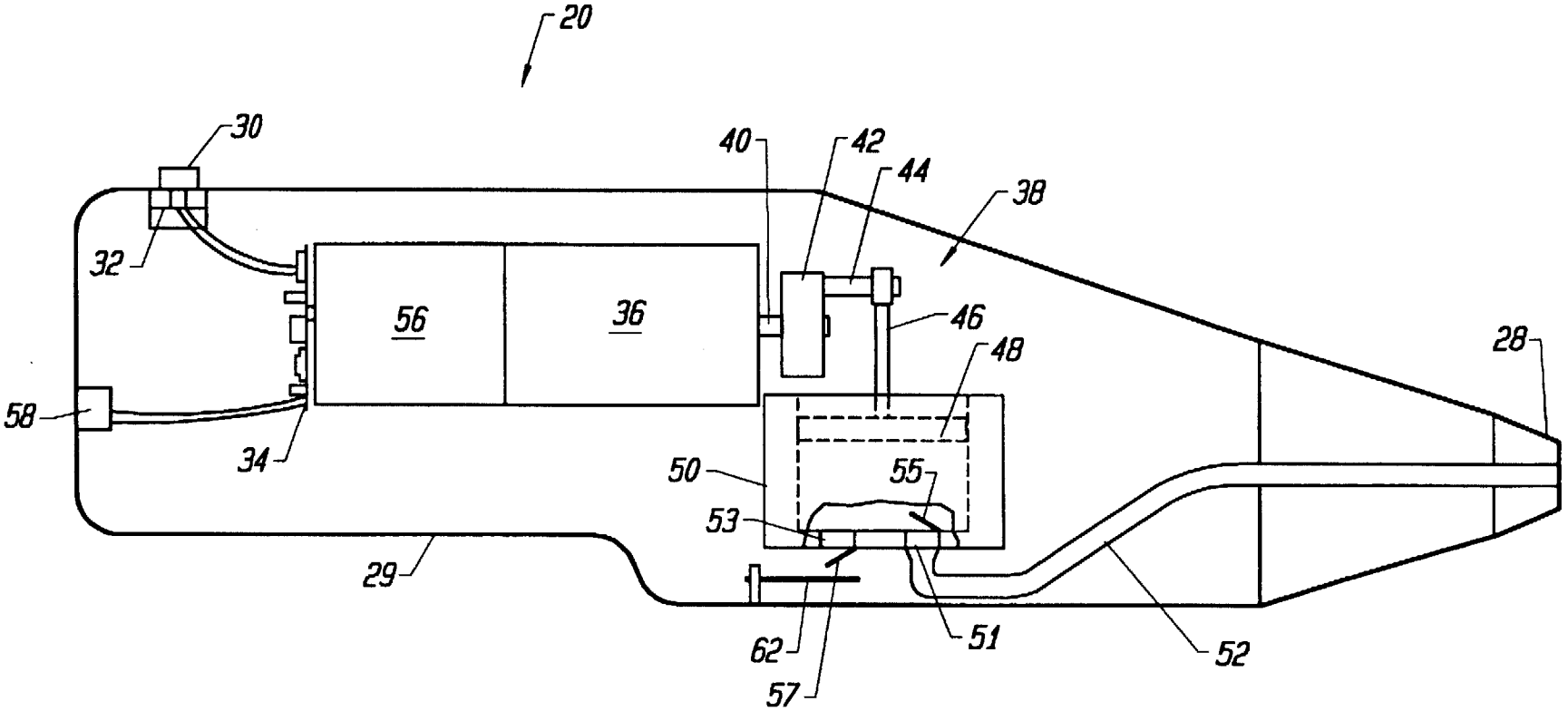
FIG. 2A is a side view of a hand held device including a vacuum sensor according to a first embodiment of the present invention.
Figure 2B:
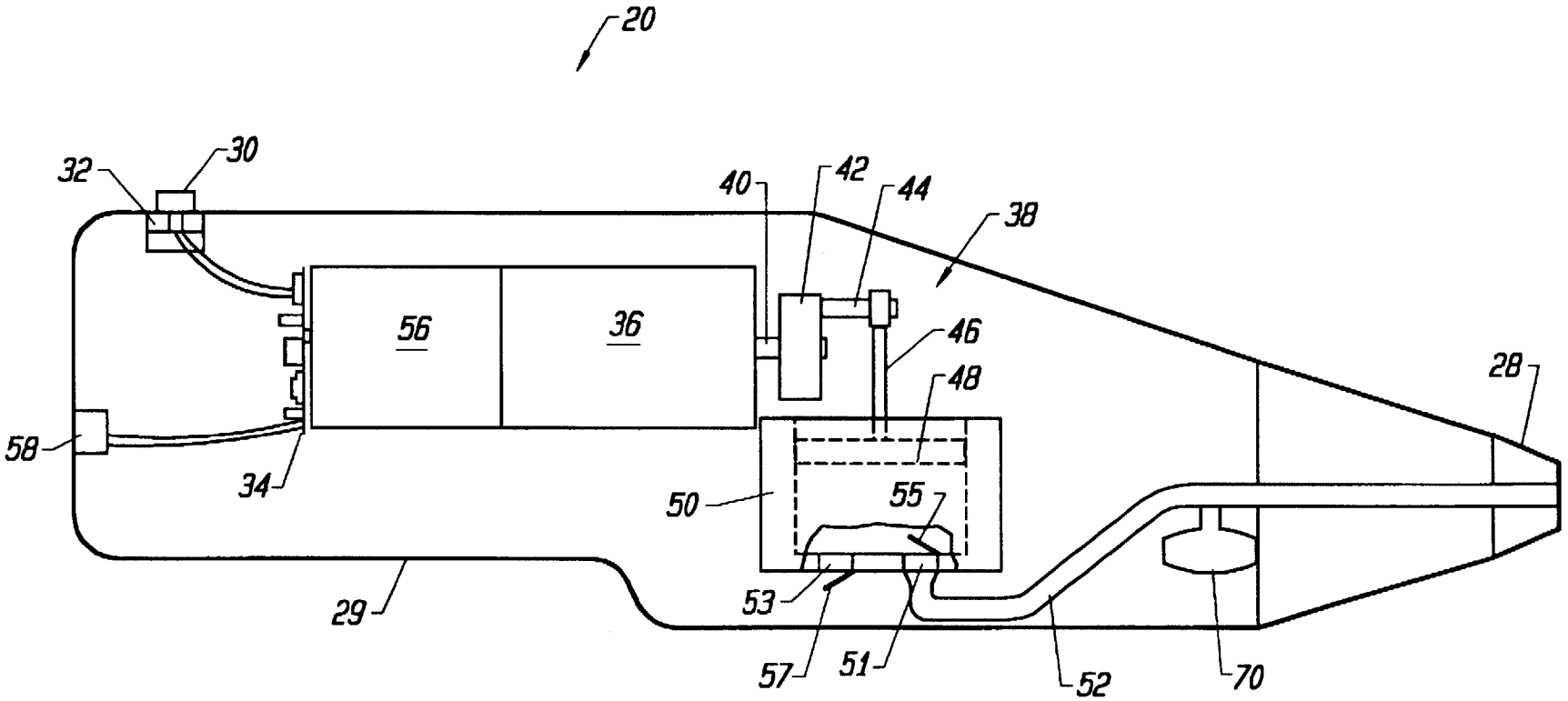
FIG. 2B is a side view of a hand held device including a vacuum sensor according to a second embodiment of the present invention.
Figure 3:
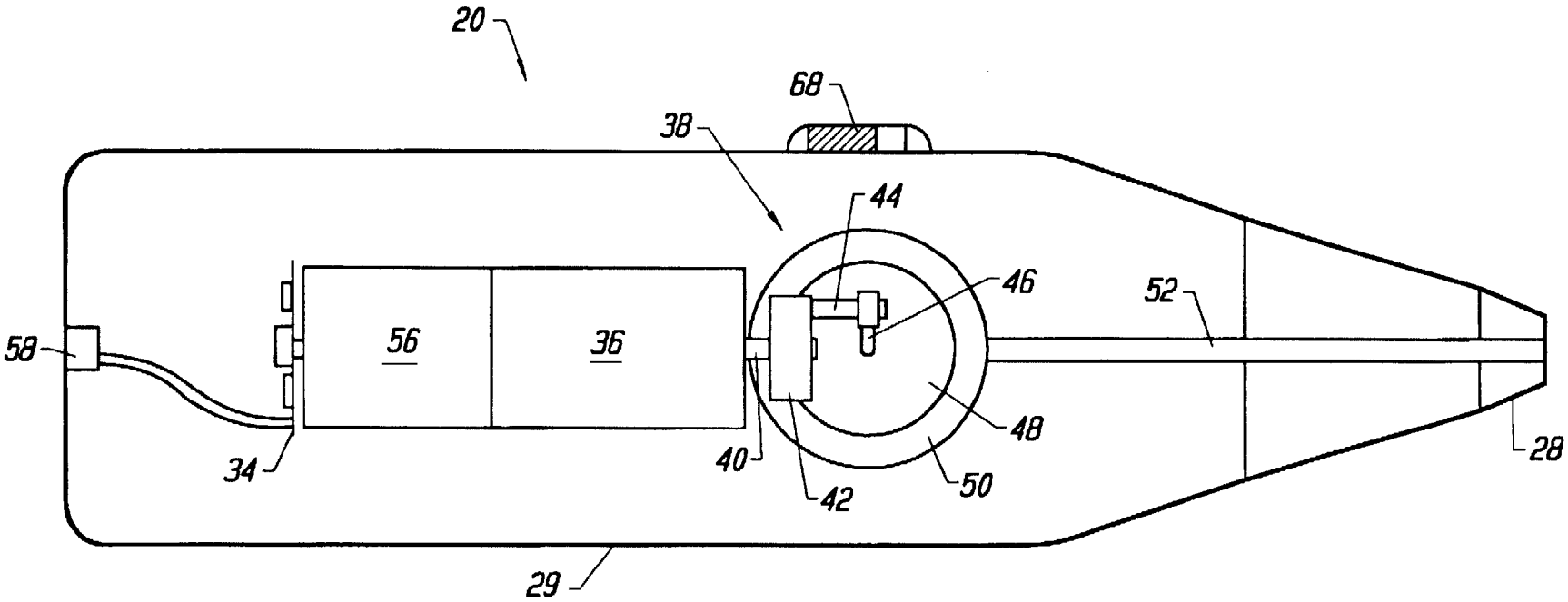
FIG. 3 is a top view of a hand held device according to the present invention.
Figure 4:
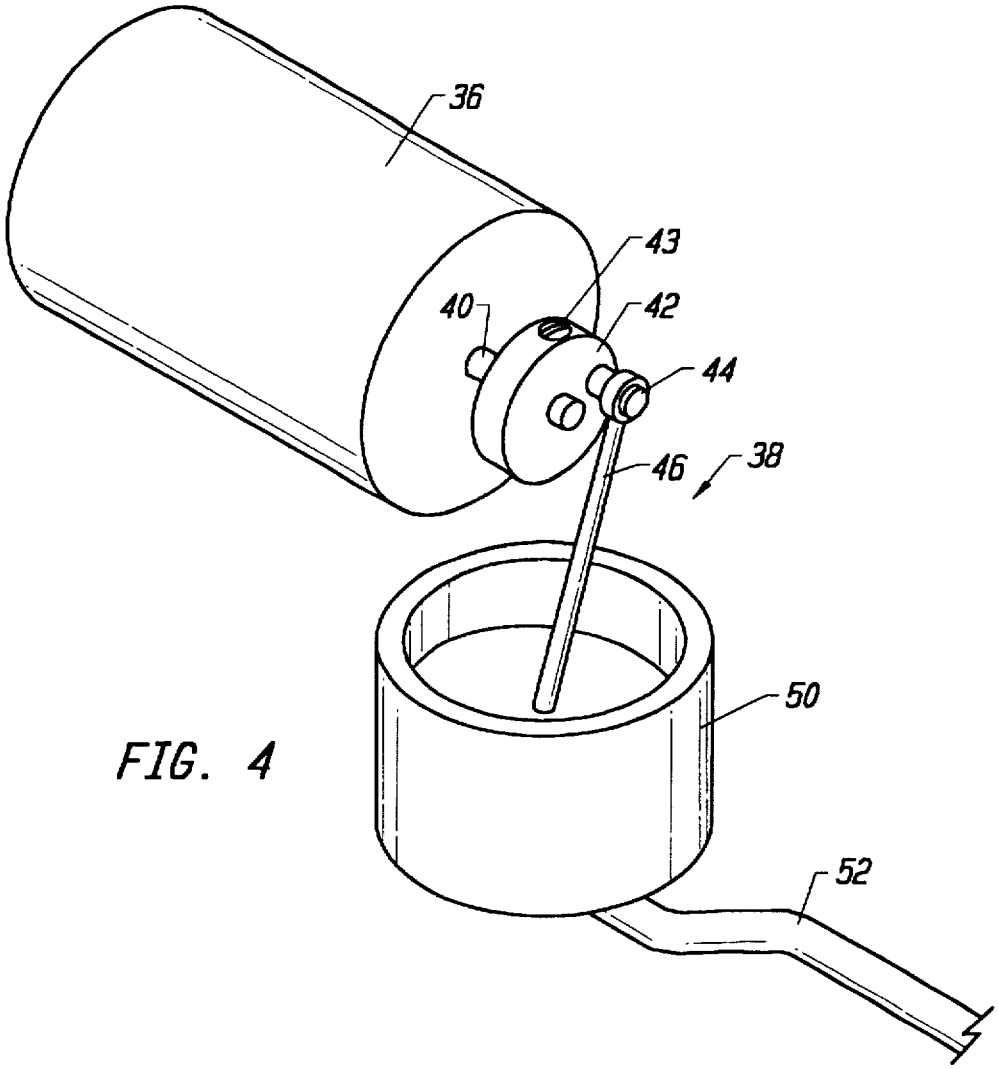
FIG. 4 is a partial perspective view of the motor and vacuum pump according to the present invention.

FIGS. 2A and 2B show side views of the device 20, and FIG. 3 shows a top view of the device 20. FIGS. 2A and 2B are identical to each other with the exception that FIG. 2A includes a vacuum sensor 62 according to a first embodiment of the invention and FIG. 2B includes a vacuum sensor 70 according to a second embodiment of the present invention. The vacuum sensors according to the various embodiments of the invention are explained hereinafter.

Referring now to FIGS. 1–4, the hand held device according to the present invention includes a housing 29 preferably formed of a durable, rigid, inexpensive and electrically non-conductive material such as any of several high-strength polymers. A hand-actuated push button 30 (FIGS. 1, 2A and 2B) is mounted within housing 29, such that depression of button 30 will close a switch 32 to begin operation of the device 20 in a known manner. As will be appreciated by those skilled in the art, components other than button 30 and switch 32 may be employed to manually begin and end operation of the device 20.

A conventional multi-pole motor 36 may be provided within housing 29 adjacent to control circuitry 34 to provide torque to a vacuum pump 38 as described hereinafter. Motor 36 includes a shaft 40 extending from the motor 36 and concentric about an axis of rotation of the motor 36. A cylindrical disc member 42 may be mounted on the motor shaft 40, which disc member in a preferred embodiment has a diameter of approximately 0.625 inches and a thickness of approximately 0.25 inches. The disc member 42 may be mounted on the shaft 40 by positioning the disc member 42 on the shaft through an aperture in the member 42, and then tightening the member 42 onto the shaft 40 by a set screw 43 threaded radially through disc member 42. The disc member 42 is preferably formed of a rigid, durable material such as, for example, aluminum or steel.

The disc member 42 includes an eccentric shaft 44 eccentrically mounted at an outer diameter of the disc member. A connecting rod 46 may be pivotally connected to the eccentric shaft 44 at its first end, and to a pump 38 at its second end. The pump 38 is comprised of a piston 48 mounted for reciprocation within a chamber 50. As shown in FIGS. 2A and 2B, the chamber includes an intake valve 51 and an exhaust valve 53 within the bottom wall of the chamber 50. The intake valve 51 includes a one-way flap 55 over the valve, which flap opens into the chamber when the piston reciprocates through a first phase where fluid is drawn into the chamber through the intake valve 51. The flap however is pressed into and seals the intake valve when the piston reciprocates through a second phase where fluid is expelled from the chamber. Similarly, the exhaust valve 53 includes a one-way flap 57 over the valve, which flap opens out of the chamber when the piston reciprocates through the second phase to expel fluid from the chamber through the exhaust valve 53. The flap however is drawn into and seals the exhaust valve when the piston reciprocates through the first phase where fluid is drawn into the chamber. A fluid flow tube 52 is mounted between the intake valve 51 and the tip 28 of the device 20 through which the pump 38 draws fluid from the container 22.

The vacuum device 20 preferably further includes a dedicated power supply such as a rechargeable battery 56 located within housing 29 at an end of the device 20 opposite the tip 26. The rechargeable battery 56 may be a conventional rechargeable battery such as a nickel-cadmium rechargeable battery which may be recharged by a recharger (not shown) via pins 58. It is also contemplated that the device 20 receives power from an external power supply (not shown) instead of, or as an alternative to, the rechargeable battery 56.

Control circuitry 34 is provided to control the operation of the device 20 in a known manner, and functions, for example, to regulate the power to motor 36 and to monitor the formation of a vacuum within container 22 in response to feedback signals from vacuum sensors as explained hereinafter.

Figure 5:
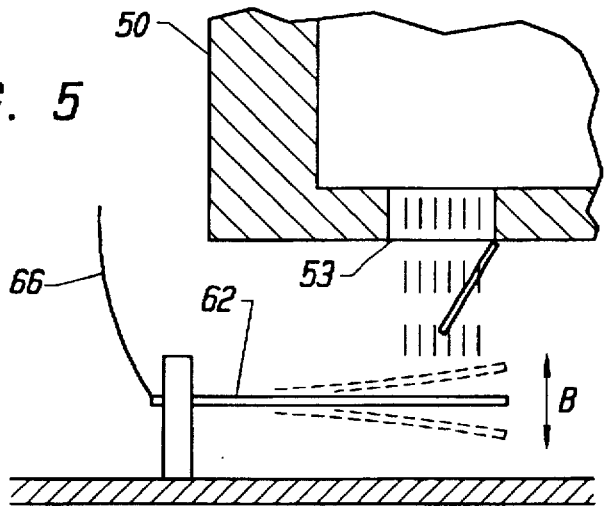
FIG. 5 is a side view of a vacuum sensor for use with the present invention.

A vacuum sensor may be provided within the device 20 for sensing the formation of a vacuum within the container 22 and for indicating when a vacuum has been substantially formed within container 22. One vacuum sensor that may be used according to the present invention is disclosed in Applicant's U.S. patent application Ser. No. 08/434,039 entitled "Exhaust Flow Rate Vacuum Sensor," which Application is hereby incorporated by reference in its entirety herein. One embodiment of the vacuum sensor disclosed in application Ser. No. 08/434,039 is shown in FIGS. 2A and 5. The sensor comprises a vibration member 62 fixedly mounted adjacent to the exhaust valve 53 so as to be within an exit stream of the fluid expelled from the pump 38. The reciprocating motion of the piston 48 (FIG. 4) within the chamber 50 causes fluid to be expelled in short, rapid fluid pulses. These pulses strike a surface of the vibration member, thereby causing the member to vibrate in the direction of arrow B. As a vacuum forms within the container 22, the force of the fluid pulses exiting the exhaust valve 53 diminishes, thereby causing an accompanying decrease in the vibrational amplitude of the vibration member.

The vibration member may be comprised of a piezoelectric material which is capable of converting vibrational amplitude of the member due to the fluid pulses into an electrical signal. As the electrical signal will alternate with the side to side vibrational swing of the member, an AC current signal is generated having a frequency equal to the frequency of vibration and a voltage that increases and decreases with the amplitude of vibration. As stated, the force of the fluid pulses upon the vibration member 62 diminishes as a vacuum is formed within container 22. The decrease in the fluid pulse force in turn decreases the vibrational amplitude of the vibration member, which in turn decreases the voltage of the generated fluid indication signal.

Figure 6:
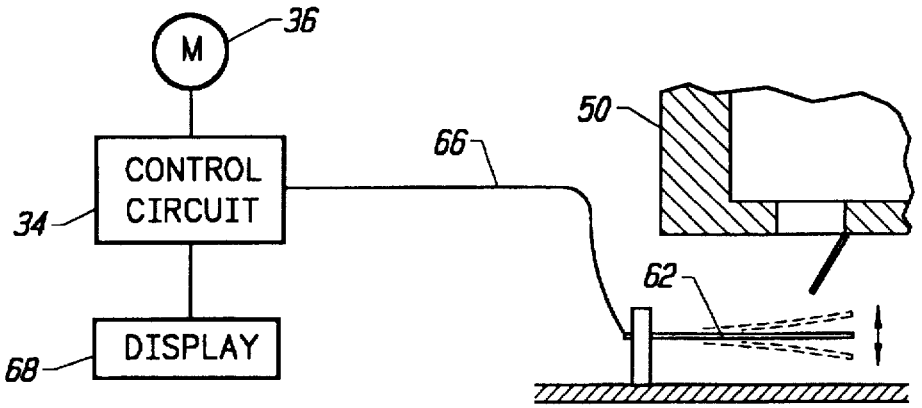
FIG. 6 is a schematic representation of the vacuum sensor shown in FIG. 5.

As shown in the schematic representation of FIG. 6, the generated fluid indication signal is input to the control circuitry 34 by a lead 66, whereupon the control circuitry may perform any of several functions based on the voltage of the fluid indication signal. For example, a dynamic vacuum indicator may be provided as a visual display 68 (FIGS. 3 and 6) on a surface of the vacuum packaging device. The dynamic vacuum indicator may be any of several conventional visual indicators. For example, the display may be in the form of a series of light emitting diodes which successively turn on or off to show the gradual formation of a vacuum within the vacuum chamber and vacuum-seal container. Alternatively, the display may be a liquid crystal display for verbally or numerically indicating the gradual formation of a vacuum within the vacuum chamber and vacuum-seal container. Furthermore, the control circuit may turn off the motor 36 when the voltage of the fluid indication signal falls below a threshold value indicating that a vacuum has been substantially established within the vacuum chamber and vacuum-seal container.

Figure 7:
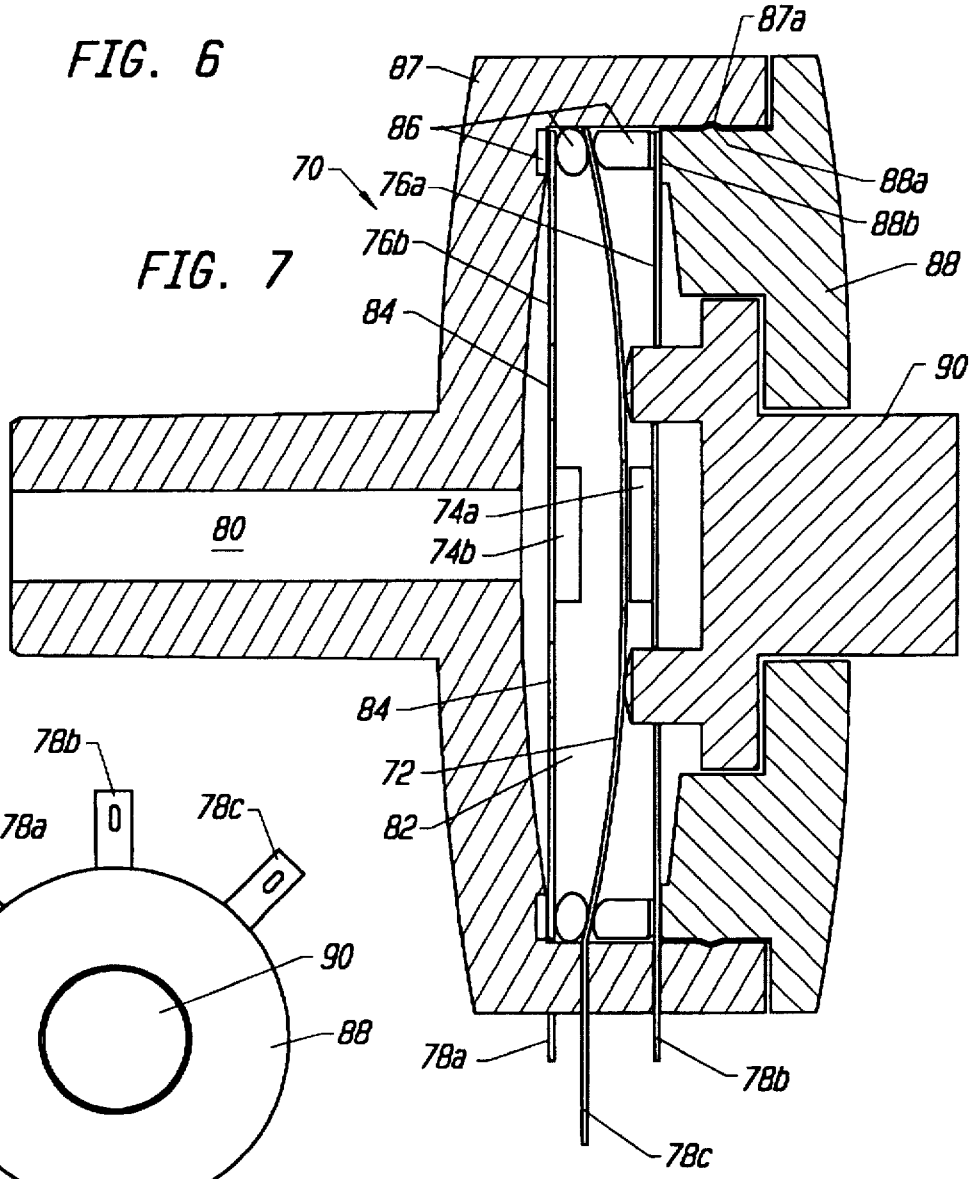
FIG. 7 is a cross-sectional side view of an alternative embodiment of a vacuum sensor according to the present invention.
Figure 8:
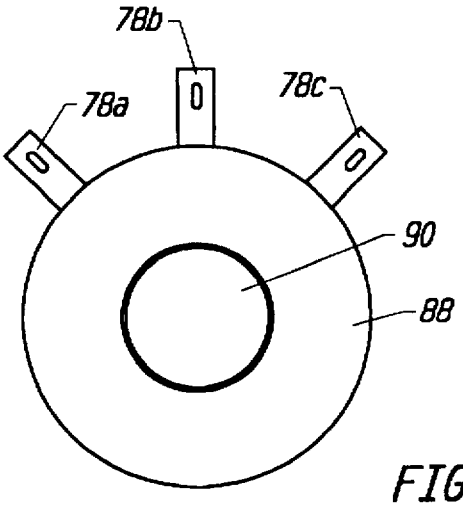
FIG. 8 is a top view of the alternative embodiment vacuum sensor shown in FIG. 7.

An alternative embodiment of the vacuum sensor is shown in FIG. 2B, the cross-sectional side view of FIG. 7, and the top view of FIG. 8. In this embodiment, the vacuum sensor comprises a double-throw pressure switch 70 in which a flexible, elastic contact membrane 72 moves between two positions. In a first position, the contact membrane lies in contact with a contact point **74*a* which is electrically and physically coupled to a contact plate 76*a*. In a second position (not shown), the contact membrane 72 lies in contact with a contact point 74*b* which is electrically and physically coupled to a contact plate 76*b*. Contact membrane 72 and contact plates 76*a* and 76*b* are electrically conductive and are electrically coupled to leads 78*a–c*. Leads 78*a–c* may in turn be electrically coupled to the control circuitry 34 or other electrical components. In a preferred embodiment, the membrane 72 and contact plates 76*a* and 76*b* may be substantially circular from a top perspective. However, the shape of the membrane 72** and the contact plates may vary in alternative embodiments.

The membrane 72 and plates **76*a* and 76*b* may be mounted in a housing 87 that mates with a cover 88. The housing 87 includes an access channel 80 which, as seen in FIG. 2B, is connected to the fluid flow tube 52 between the intake valve 51 and the device tip 28, so that the air pressure within the fluid flow tube measures within the access channel 80. Although shown adjacent to the tip 28 of the device 20, it is understood that the switch 70 may be connected to the fluid flow tube 52 at any location between the intake valve 51 and the tip 28. A chamber 82, having contact membrane 72 as a wall, is defined within the switch, which chamber 82 communicates with the access channel 80 via holes 84 provided within the contact plate 76*b*. Sealing gaskets 86 are provided around the periphery of the chamber 82 to ensure that the chamber 82 and access channel 80** comprise an air-tight environment.

The contact membrane 72 is formed with a dome-like shape having a curvilinear cross section as shown in FIG. 7. This shape provides the membrane 72 with an inherent bias into the first position, where a center of the membrane 72 bows outward into contact with contact point **74*a* on contact plate 76*a*. The membrane 72 is an elastic component such that, upon application of a force to the membrane, the dome-like shape may invert so that the center of membrane bows outward into contact with point 74*b* on contact plate 76*b***, and then return to the first position upon removal of the force.

In operation, once the motor 36 is switched on and evacuation of the container 22 begins, the pressure, which may be referred to as a reference pressure, within fluid flow tube 52 and access channel 80 will decrease. Once the reference pressure within the channel 80 and chamber 82 drops below a certain predetermined value, the pressure differential on opposite sides of the membrane 72 will create a resultant force on membrane 72 sufficient to overcome the inherent bias of the membrane 72 into the first position. At this point, the membrane 72 will switch from the first position in contact with the contact plate **76*a* into the second position in contact with plate 76*b*. Thus, switch 70 is preferably a break-before-make component which switches between a first electrical circuit including membrane 72 and plate 76*a*, and a second electrical circuit including membrane 72 and plate 76*b***.

In a preferred embodiment, breaking the electrical circuit including plate **76*a* shuts off power to the pump 38 to cease further evacuation of the container. This may be accomplished via control circuitry 34, or by including the lead 78*b* in the power circuit between the power supply 56 and the pump 38. Closing of the electrical circuit including plate 76*b* and lead 78*a* may be used for any of several functions, including visual indication of vacuum formation, as by a visual indicator. While the switch 70 has the capability to switch between two electrical functions, it is understood that the switch 70 may also act as an on/off switch for a single electrical component. For example, upon switching to the second position, a vacuum indicator may be turned on, whereupon a user of the device 20 may let go of the push-button 30 to stop the pump 38. Moreover, the switch 70** may operate to add a second electrical function upon switching to the second position while continuing operation of the first electrical function.

It is a feature of the double-throw pressure switch 70 that the switching of the membrane 72 between plates 76*a* and 76*b* , and consequently the switching of electrical circuits, occurs nearly instantaneously. Due to the above-described inherent bias of membrane 72, the membrane 72 remains in contact with the plate 76*a* until the pressure differential on opposite sides of membrane 72 reaches a predetermined level, at which point the membrane 72 snaps quickly over to plate 76*b*. Nearly instantaneous switch of the double-throw pressure switch 70 minimizes the time during which neither the electrical circuit through lead 78*a* or 78*b* is enabled. Thus, for example, where switch 70 operates to enable a second electrical function while continuing the first electrical function, there is minimal interruption of the first electrical function during the switch over. Additionally, a nearly instantaneous switch over minimizes the time over which electrical arcing may occur during the switch over.

As would be appreciated by one skilled in the art, the pressure differential at which the contact membrane switches from the first position to the second position may be controlled by controlling the physical parameters of the membrane, such as for example its shape, thickness, rigidity, size, etc.

As shown in FIG. 7, the cover 88 may be snap fit into the housing 87 by means of a protrusion 88*a* on the cover being received within a detent 87*a* within the housing. However, in an alternative embodiment (not shown), the housing 87 may include screw threads that mate with threads formed in the cover, so that the cover may be screwed into the housing. In this alternative embodiment, as a result of screwing the cover far enough into the housing 87, a surface 88*b* of cover 88 may exert a compressive force on gaskets 86, which in turn exert a force on an outer circumference of membrane 72. This force on the outer circumference of membrane 72 tends to flatten out the membrane 72, thereby decreasing the force necessary to move the membrane from the first position in contact with plate 76*a* to the second position in contact with plate 76*b*. Therefore, the point at which the double-throw switch 70 switches during the operation of the vacuum device 20 may be adjusted by screwing the cover 88 further into or away from the housing 87.

The double-throw pressure switch 70 further includes a manual switch button 90. By depressing the button 90, the membrane may be manually moved from the first position to the second position, to thereby accomplish manual switching of switch 70 from the first electrical circuit to the second electrical circuit.

While the double-throw pressure switch 70 has thus far been described in the context of the hand-held vacuum device 20, it is understood that the switch 70 may be used in a wide variety of applications where it is desired to use a change in pressure as a switching condition. For example, the switch 70 may be incorporated in a counter top vacuum packaging device such as that disclosed in applicant's above-described U.S. Pat. No. 4,941,310, which patent is hereby incorporated by reference in its entirety herein. In such a device, the electrical circuit associated with the first position of sensor 70 may be used, for example, to provide power to the vacuum pump, and the electrical circuit associated with the second position of sensor 70 may be used, for example, to initiate the heat sealing process by which the evacuated bags are sealed. In such an embodiment, the heat sealing process may be manually initiated at any desired point by pressing button 90.

Additionally, the switch 70 has thus far been described above as switching from the first position to the second position when a pressure on one side of the membrane has decreased by a predetermined amount relative to a constant pressure on the second side of the membrane. However, it is understood that the switch 70 may also operate such that the membrane 72, initially biased into a first position, will switch to a second position as result of a pressure increase against one side of the membrane.

Although the invention has been described in detail herein, it should be understood that the invention is not limited to the embodiments herein disclosed. Various changes, substitutions and modifications may be made thereto by those skilled in the art without departing from the spirit or scope of the invention as described and defined by the appended claims.

I claim:

1. A device for forming a vacuum in a container, comprising:

a housing adapted to be held by hand;

a pump for evacuating fluid from the container;

a motor for driving said pump;

means for communicating a motive force from said motor to said pump;

control means for controlling operation of said motor; and a vacuum sensor, including:

a membrane capable of moving between a first position and a second position, said membrane being biased into said first position and said membrane having a first side and a second side;

a chamber in communication with an interior of the container so as to have a similar pressure as the container, said first side of said membrane forming a wall interior to said chamber and said second side of said membrane forming a wall exterior to said chamber;

wherein said membrane snaps from said first position to said second position when forces biasing said membrane into said second position overcome forces biasing said membrane into said first position.

2. A device for forming a vacuum in a container as recited in claim 1, further comprising means for operating said pump when said membrane is in said first position and for shutting off said pump when said membrane is in said second position.

3. A device for forming a vacuum in a container as recited in claim 1, further including means for indicating a vacuum when said membrane is in said second position.

4. A device for forming a vacuum in a container as recited in claim 1, further including means for operating said pump when said membrane is in said first position and for shutting off said pump when said membrane is in said second position.

5. A device for forming a vacuum in a container, comprising:

a housing adapted to be held by hand;

a pump for evacuating fluid from the container;

a motor for driving said pump;

means for communicating a motive force from said motor to said pump;

control means for controlling operation of said motor; and a vacuum sensor, including:

a membrane capable of moving between a first fixed position and a second fixed position;

a chamber having a first pressure that decreases with a decrease in a pressure within the container, said first pressure exerting a force on said first side of said membrane;

a second pressure for exerting a force on a second side of said membrane opposite said first side;

wherein said membrane moves from said first fixed position to said second fixed position when forces biasing said membrane into said second fixed position become greater than forces opposing movement of said membrane into said second fixed position.

6. A device for forming a vacuum in a container as recited in claim 5, wherein said membrane has an inherent bias into said first position.

7. A device for forming a vacuum in a container as recited in claim 5, further comprising a button for transmitting a force applied to said button to said second side of said membrane.

8. A device for forming a vacuum in a container as recited in claim 5, wherein a first electrical function is enabled when said membrane is in said first position and a second electrical function is enabled when said membrane is in said second position.

9. A device for forming a vacuum in a container as recited in claim 8, wherein said first electrical function is supplying power to said pump.

10. A device for forming a vacuum in a container, comprising:

a device housing adapted to be held by hand;

a pump for evacuating fluid from the container;

a motor for driving said pump;

means for communicating a motive force from said motor to said pump;

control means for controlling operation of said motor; and a vacuum sensor, including:

a sensor housing;

a cover mating with said housing;

a first electrically conductive component;

a second electrically conductive component;

a third electrically conductive component;

an electrically conductive membrane capable of moving between a first position where said electrically conductive membrane electrically couples said third electrically conductive component to said first electrically conductive component, and a second position where said electrically conductive membrane electrically couples said third electrically conductive component to said second electrically conductive component, said membrane being biased into said first position;

a chamber having a first pressure that decreases with a decrease in pressure within the container, said first pressure exerting a force on said first side of said membrane;

a second pressure for exerting a force on a second side of said membrane opposite said first side;

wherein said membrane moves from said first position to said second position when forces biasing said membrane into said second position become greater than forces biasing said membrane into said first position.

11. A device for forming a vacuum in a container as recited in claim 10, said cover being capable of occupying a first location with respect to said housing which exerts a first force on said membrane opposing said bias of said membrane into said first position, and said cover capable of occupying a second location with respect to said housing which exerts a second force on said membrane opposing said bias of said membrane into said first position, said first force being greater than said second force, such that said membrane is biased into said first position to a greater extent when said cover occupies said first location as compared to when said cover occupies said second location.

12. A device for forming a vacuum in a container as recited in claim 11, said cover and said housing being provided with mating threaded surfaces, said cover moving between said first and second locations with respect to said housing by rotating said cover with respect to said housing.

13. A switch for switching between a first state and a second state upon a change in a reference pressure, comprising:

a housing;

a cover mating with said housing;

a membrane positioned within a space defined by said housing and cover, said membrane capable of moving between a first position where the first state is enabled, and a second position where the second state is enabled;

a chamber defined between said membrane and said cover, said chamber having a first pressure that changes with a change in the reference pressure, said first pressure exerting a force on said first side of said membrane; and a second pressure for exerting a force on a second side of said membrane opposite said first side;

wherein said membrane snaps from said first position to said second position when forces biasing said membrane into said second position become greater than forces biasing said membrane into said first position; and wherein said cover is capable of occupying a first location with respect to said housing which exerts a first force on said membrane opposing said bias of said membrane into said first position, and said cover capable of occupying a second location with respect to said housing which exerts a second force on said membrane opposing said bias of said membrane into said first position, said first force being greater than said second force, such that said membrane is biased into said first position to a greater extent when said cover occupies said first location as compared to when said cover occupies said second location, and wherein said cover and said housing are provided with mating threaded surfaces, said cover moving between said first and second locations with respect to said housing by rotating said cover with respect to said housing.

14. A device for forming a vacuum in a container, comprising:

a device housing adapted to be held by hand;

a pump for evacuating fluid from the container;

a motor for driving said pump;

means for communicating a motive force from said motor to said pump;

control means for controlling operation of said motor; and a vacuum sensor, including:

a sensor housing;

a cover mating with said housing;

a first electrically conductive component;

a second electrically conductive component;

a membrane capable of moving between a first position where said membrane is electrically coupled to said first electrically conductive component, and a second position where said membrane is electrically coupled to said second electrically conductive component, said membrane being biased into said first position;

a chamber having a first pressure that decreases with a decrease in pressure within the container, said first pressure exerting a force on said first side of said membrane;

a second pressure for exerting a force on a second side of said membrane opposite said first side;

wherein said membrane moves from said first position to said second position when forces biasing said membrane into said second position become greater than forces biasing said membrane into said first position; and said cover capable of occupying a first location with respect to said housing to exert a first force on said membrane opposing said bias of said membrane into said first position, and said cover capable of occupying a second location with respect to said housing to exert a second force on said membrane opposing said bias of said membrane into said first position, said first force being greater than said second force, such that said membrane is biased into said first position to a greater extent when said cover occupies said first location as compared to when said cover occupies said second location.

15. A device for forming a vacuum in a container as recited in claim 14, said cover and said housing provided with mating threaded surfaces, said cover moving between said first and second locations with respect to said housing by rotating said cover with respect to said housing.

16. A switch for switching between a first state and a second state upon a change in a reference pressure, comprising:

a housing;

a cover mating with said housing;

a membrane capable of moving between a first position where the first state is enabled, and a second position where the second state is enabled, said membrane being biased into said first position;

a chamber having a first pressure that changes with a change in the reference pressure, said first pressure exerting a force on said first side of said membrane;

a second pressure for exerting a force on a second side of said membrane opposite said first side;

wherein said membrane moves from said first position to said second position when forces biasing said membrane into said second position become greater than forces opposing movement of said membrane into said second position; and said cover capable of occupying a first location with respect to said housing to exert a first force on said membrane opposing said bias of said membrane into said first position, and said cover capable of occupying a second location with respect to said housing to exert a second force on said membrane opposing said bias of said membrane into said first position, said first force being greater than said second force, such that said membrane is biased into said first position to a greater extent when said cover occupies said first location as compared to when said cover occupies said second location, said cover and said housing provided with mating threaded surfaces, said cover moving between said first and second locations with respect to said housing by rotating said cover with respect to said housing.

* * * * *